US011427018B2

(12) United States Patent
Yoshikawa

(10) Patent No.: US 11,427,018 B2
(45) Date of Patent: Aug. 30, 2022

(54) PRINTING APPARATUS AND PRINTING METHOD

(71) Applicant: SEIKO EPSON CORPORATION, Tokyo (JP)

(72) Inventor: Eishin Yoshikawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/372,800

(22) Filed: Jul. 12, 2021

(65) Prior Publication Data

US 2022/0016910 A1 Jan. 20, 2022

(30) Foreign Application Priority Data

Jul. 14, 2020 (JP) ..... JP2020-120443

(51) Int. Cl.
*B41J 11/00* (2006.01)

(52) U.S. Cl.
CPC .... *B41J 11/00212* (2021.01); *B41J 11/00214* (2021.01)

(58) Field of Classification Search
CPC ..... B41J 11/00212; B41J 11/00214
See application file for complete search history.

(56) References Cited

U.S. PATENT DOCUMENTS

2018/0207956 A1* 7/2018 Mezaki ..... B41J 25/3082

FOREIGN PATENT DOCUMENTS

JP 2017-001288 A 1/2017

* cited by examiner

*Primary Examiner* — Bradley W Thies
(74) *Attorney, Agent, or Firm* — Global IP Counselors, LLP

(57) ABSTRACT

A printing apparatus and a printing method, including a first irradiation unit provided at one side in a main scanning direction with respect to a reference region in which the nozzle row is provided, and a second irradiation unit provided at another side, wherein at least one of the first irradiation unit and the second irradiation unit irradiates and changes an irradiation position different from a directly-below irradiation position.

7 Claims, 12 Drawing Sheets

PRINTING APPARATUS AND PRINTING METHOD

The present application is based on, and claims priority from JP Application Serial Number 2020-120443, filed Jul. 14, 2020, the disclosure of which is hereby incorporated by reference herein in its entirety.

BACKGROUND

1. Technical Field

The present disclosure relates to a printing apparatus and a printing method.

2. Related Art

Recently, as a printing apparatus that uses ultraviolet light curing ink, a serial inkjet printer is known that includes ultraviolet irradiators on both ends of a printing head along a scanning direction. For example, JP-A-2017-1288 discloses a technique in which clear ink is discharged after image formation with color ink, and gloss irregularity generated during bi-directional printing is suppressed.

The gloss irregularity occurs since a time from when the ultraviolet curing ink lands on a printing medium until being irradiated with ultraviolet light differs between a forward path and a return path. The technique described in JP-A-2017-1288 requires the use of clear ink to suppress the gloss irregularity, while a technique for suppressing the gloss irregularity without using clear ink is desired even when using a printing head having a stagger structure in which distances to the ultraviolet irradiators disposed at both ends are asymmetric.

SUMMARY

A printing apparatus includes a nozzle row configured to discharge ink onto a printing medium, a main scanning unit configured to change a relative position between the printing medium and the nozzle row in a main scanning direction, a first irradiation unit provided on one side, in the main scanning direction, of a reference region in which the nozzle row is provided, and a second irradiation unit provided on another side, in the main scanning direction, of the reference region, wherein at least one of the first irradiation unit and the second irradiation unit is configured to perform irradiation at an irradiation position different from a directly-below irradiation position, the directly-below irradiation position being a irradiation position when irradiation is performed directly below, when a distance between a center of the reference region and a center of the irradiation position of the first irradiation unit is a first distance, a distance between a center of the reference region and a center of the irradiation position of the second irradiation unit is a second distance, a distance between a center of the reference region and a center of the directly-below irradiation position of the first irradiation unit is a third distance, and a distance between a center of the reference region and a center of the directly-below irradiation position of the second irradiation unit is a fourth distance, the nozzle row, the first irradiation unit, and the second irradiation unit are provided so that the third distance and the fourth distance are different from each other, and the first irradiation unit and the second irradiation unit are configured to perform irradiation so that the following condition is satisfied: |the first distance−the second distance|<|the third distance−the fourth distance|.

A printing method for a printing apparatus including a nozzle row configured to discharge ink onto a printing medium, a main scanning unit configured to change a relative position between the printing medium and the nozzle row in a main scanning direction, a first irradiation unit provided on one side, in the main scanning direction, of a reference region in which the nozzle row is provided, and a second irradiation unit provided on another side, in the main scanning direction, of the reference region, wherein at least one of the first irradiation unit and the second irradiation unit is configured to perform irradiation at an irradiation position different from a directly-below irradiation position, the directly-below irradiation position being a irradiation position when irradiation is performed directly below, when a distance between a center of the reference region and a center of an irradiation position of the first irradiation unit is a first distance, a distance between a center of the reference region and a center of an irradiation position of the second irradiation unit is a second distance, a distance between a center of the reference region and a center of the directly-below irradiation position of the first irradiation unit is a third distance, and a distance between a center of the reference region and a center of the directly-below irradiation position of the second irradiation unit is a fourth distance, the nozzle row, the first irradiation unit, and the second irradiation unit are provided so that the third distance and the fourth distance are different from each other, and the printing method comprises a first irradiation unit lighting step for lighting up the first irradiation unit and a second irradiation unit lighting step for lighting up the second irradiation unit so that the following condition is satisfied: |the first distance−the second distance|<|the third distance−the fourth distance|.

DESCRIPTION OF EXEMPLARY EMBODIMENTS

1. First Exemplary Embodiment

Hereinafter, a printing apparatus according to an exemplary embodiment of the present disclosure will be described. An example of the printing apparatus in the present exemplary embodiment is a serial inkjet printer. Hereinafter, the following serial inkjet printer is simply referred to as a printer.

In the X-Y-Z coordinate system illustrated in each drawing, the X direction indicates a width direction or a main scanning direction, the Y direction indicates a depth direction or a sub scanning direction, and the Z direction indicates a height direction or a vertical direction.

A tip side of the arrow indicating the Y direction is defined as a front or downstream direction, and a base end side is defined as a rear or upstream direction. Further, a tip side of the arrow indicating the X direction when viewed from the front of the apparatus is defined as a right direction, and a base end side is defined as a left direction. Further, a tip end side of the arrow indicating the Z direction is defined as an upward direction, and a base end side is defined as downward direction. Note that the sub scanning direction is a direction from the base end side to the tip side of the arrow indicating the Y direction. The sub scanning direction is a direction that intersects with the main scanning direction.

Figure 1:
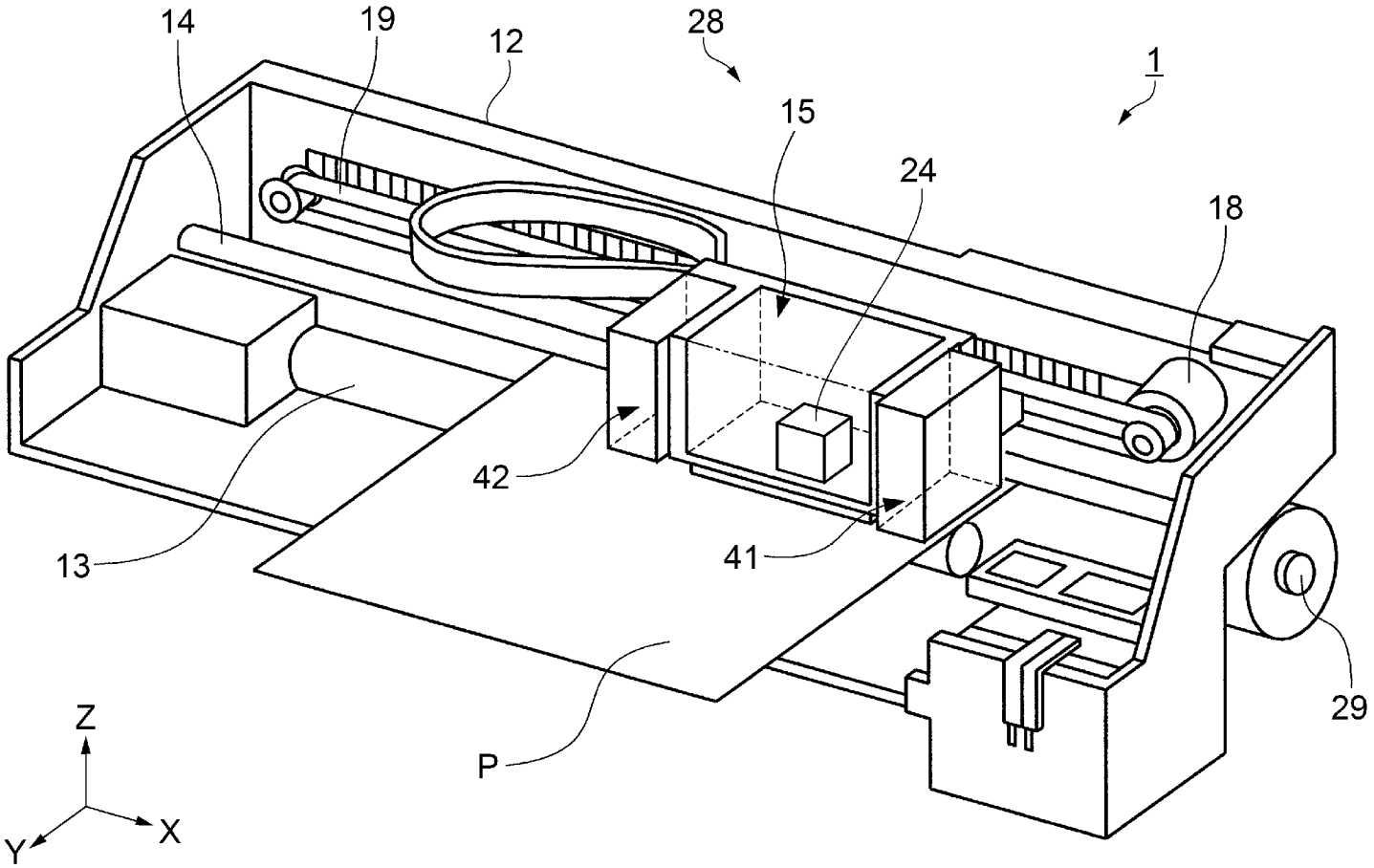
FIG. 1 is a perspective view illustrating an entire printer according to a first exemplary embodiment.
Figure 2:
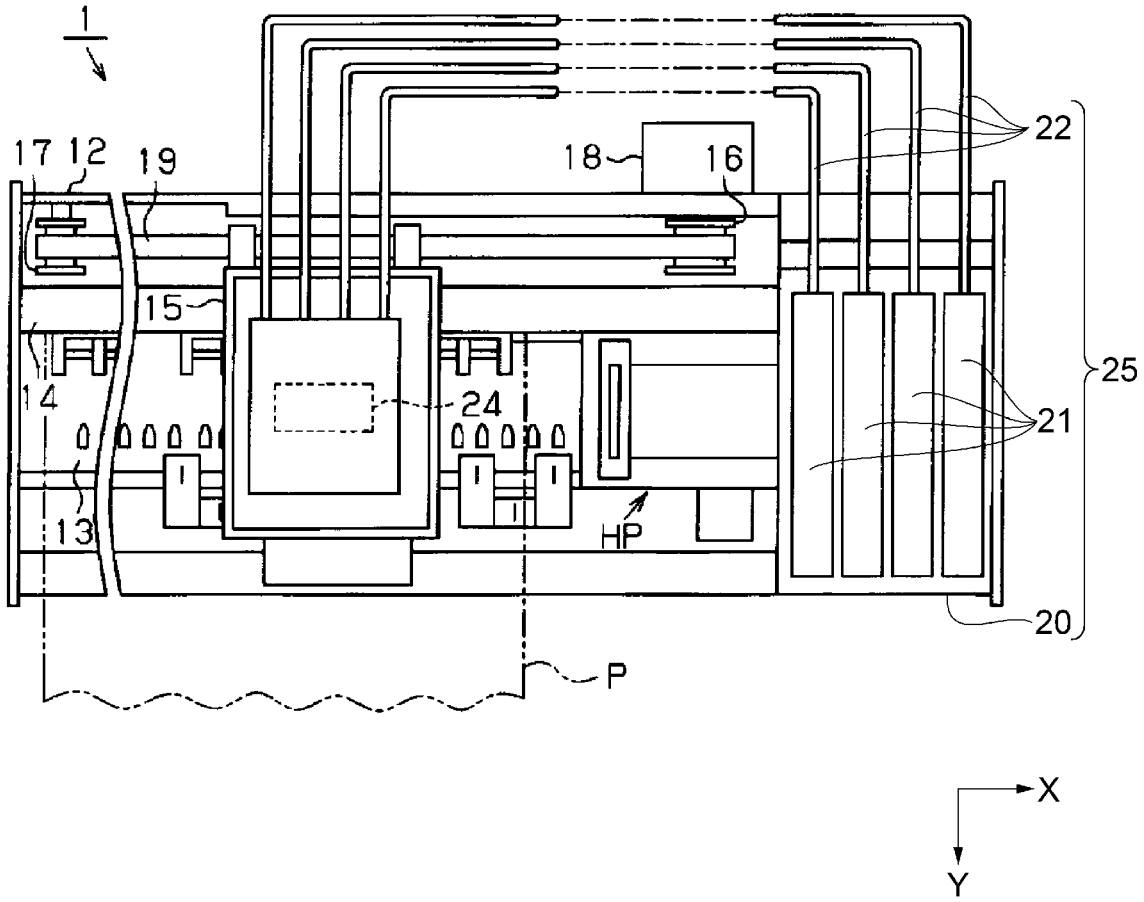
FIG. 2 is a perspective plan view of the printer as viewed from above.
Figure 3:
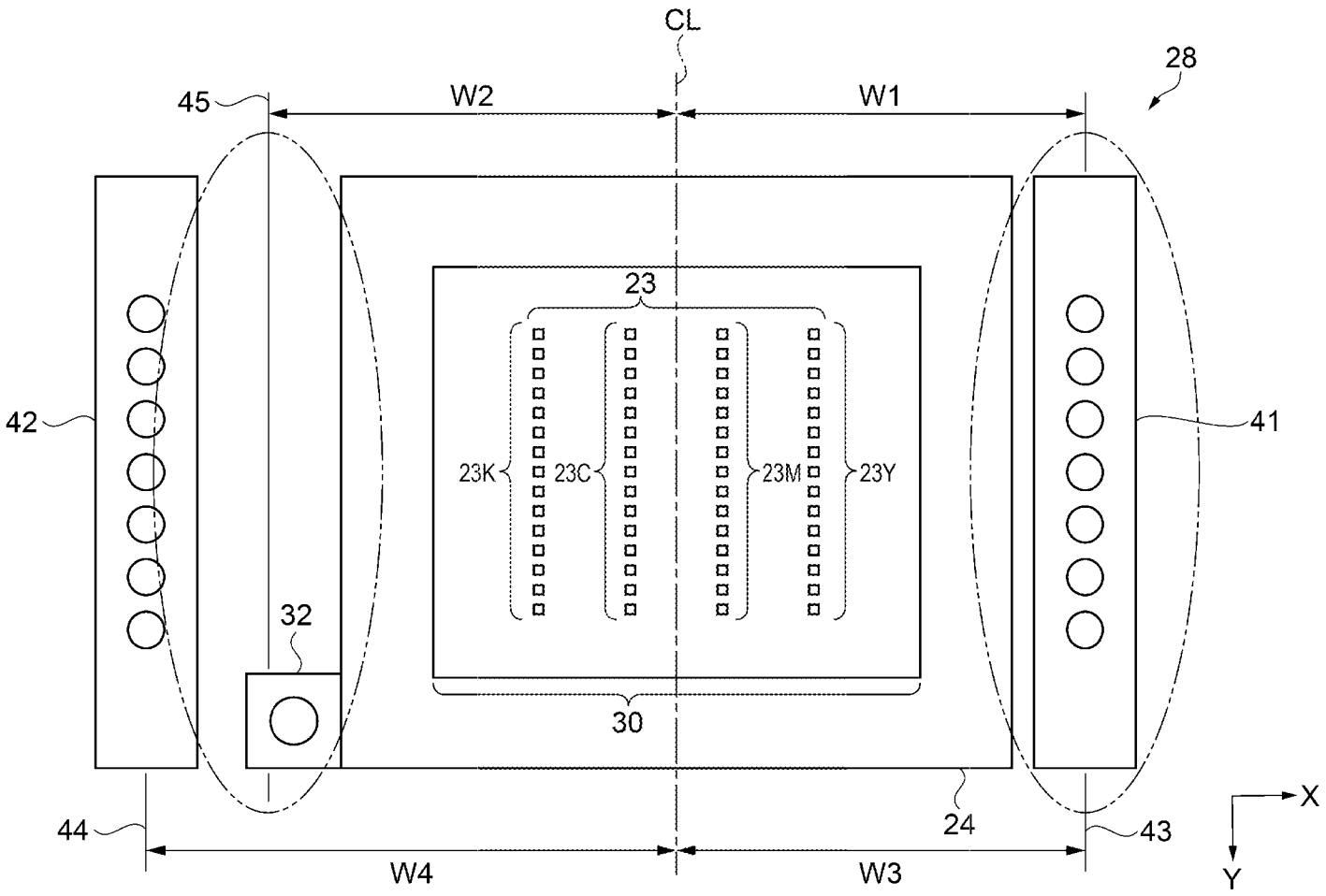
FIG. 3 is a perspective plan view of a main scanning unit as viewed from above.

FIG. 1 is a perspective view illustrating an entire printer 1 capable of performing an inkjet method according to the present disclosure. FIG. 2 is a perspective plan view of the printer 1 as viewed from above. FIG. 3 is a perspective plan view of a carriage 15 as viewed from above. A printing head 24 of the printer 1 is mounted at the carriage 15.

1.1. Main Scanning Unit

As illustrated in FIGS. 1 to 3, the printer 1 includes a main scanning unit 28 and an ink supply unit 25. The main scanning unit 28 includes a printing head 24 that discharges ultraviolet light curing ink as an example of ink, and a first irradiation unit 41 and a second irradiation unit 42 that irradiate the ultraviolet light curing ink with ultraviolet light. The ink supply unit 25 supplies the ultraviolet light curing ink to the printing head 24. Hereinafter, the ultraviolet light curing ink is referred to as "UV ink".

The printing head 24 is provided with a plurality of nozzle holes for discharging ink onto a printing medium P. A nozzle row 23, which is a set of four colors, is provided, where a single nozzle is allocated in parallel with the sub scanning direction as illustrated in FIG. 3. For example, in the nozzle row 23, a nozzle row 23Y is assigned to yellow, a nozzle row 23M is assigned to magenta, a nozzle row 23C is assigned to cyan, and a nozzle row 23K is assigned to black. An installation range including the nozzle row 23 is referred to as a reference region 30. As illustrated in FIG. 3, the reference region 30 has a long rectangle shape in the main scanning direction in plan view, and is disposed at the center of the printing head 24. Each of the color nozzle rows 23Y, 23M, 23C, and 23K are disposed at equal intervals in the main scanning direction at the center of the reference region 30.

Note that the nozzle row 23 of the printing head 24 illustrated in FIG. 3 may be formed in a plurality of rows per color, without being limited to in one row per color. In addition, the nozzle row 23 is arranged parallel to the sub scanning direction, while the nozzle row 23 may be arranged inclinedly with respect to the sub scanning direction (not illustrated).

As illustrated in FIG. 3, the printer 1 is provided with a PW sensor 32 that optically detects a paper width of the printing medium P below the left side surface of the printing head 24. The PW sensor 32 detects the paper width by optically detecting a paper end while reciprocating in association with the main scanning unit 28 described below. The PW sensor 32 is required for borderless printing for performing printing to the full width of the paper, for example. The PW sensor 32 can also serve as a function of measuring ink concentration on the printing medium P in addition to detecting the paper width.

The main scanning unit 28 is provided with the carriage 15 at which the printing head 24 is mounted. The main scanning unit 28 performs image formation by changing a relative position of the printing medium P and the nozzle row 23 in the main scanning direction by a carriage motor 18 described later. The carriage 15 includes a pair of left and right ultraviolet irradiation units with the printing head 24 interposed therebetween, with the first irradiation unit 41 on the right side and the second irradiation unit 42 on the left side.

As illustrated in FIG. 2, a guide shaft 14 supports the main scanning unit 28 and extends in the X direction. The guide shaft 14 is provided along the X direction on the rear side of the main scanning unit 28. The guide shaft 14 extends to a width of ¾ of the apparatus that is a movable range in the main scanning direction of the carriage 15. A carriage motor 18 is installed within an apparatus housing 12 on the right side of the guide shaft 14. The carriage motor 18 independently drives the main scanning unit 28. The carriage motor 18 is provided with a rotation axis along the Y direction. A drive pulley 16 is coupled to the tip of the rotation shaft. On the left side opposite the drive pulley 16, a rotatable pulley 17 is installed within the apparatus housing 12 along the rotation axis in the Y direction. Furthermore, a timing belt 19 having an endless shape is hooked between the left and right pulleys 16, 17. The main scanning unit 28 including the carriage 15 is coupled to the timing belt 19 behind the main scanning unit 28. The timing belt 19 is driven by the rotation of the carriage motor 18. As a result, the main scanning unit 28 including the carriage 15 reciprocates in the main scanning direction along the guide shaft 14.

1.2. Ink Supply Unit

As illustrated in FIG. 2, a box shaped cartridge holder 20 is provided in a space of approximately ¼ of the right side of the apparatus housing 12 of the printer 1. The cartridge holder 20 includes, for example, four ink cartridges 21 accommodating UV ink per color. The ink cartridges 21 are removably mounted for each color. Each of the ink cartridges 21 is mounted to the cartridge holder 20 and is coupled to an upstream end of an ink supply tube 22. Further, an downstream end of each ink supply tube 22 is coupled to the printing head 24 mounted at the carriage 15. The ink supply unit 25 supplies the UV ink to the nozzle row 23 having the plurality of nozzle holes via an ink flow path configured at a bottom surface of the printing head 24 by a supply pump (not illustrated).

Note that, in the present exemplary embodiment, a so-called on-carriage type may be employed in which the cartridge holder 20 and the ink cartridges 21 are mounted at the carriage 15.

The UV ink accommodated in the ink cartridges 21 is not limited to four colors, and the number of colors may be further increased. In addition to color ink, special ink such as clear ink, white ink, etc. may be included.

1.3. Ultraviolet Irradiation Unit

Figure 4:
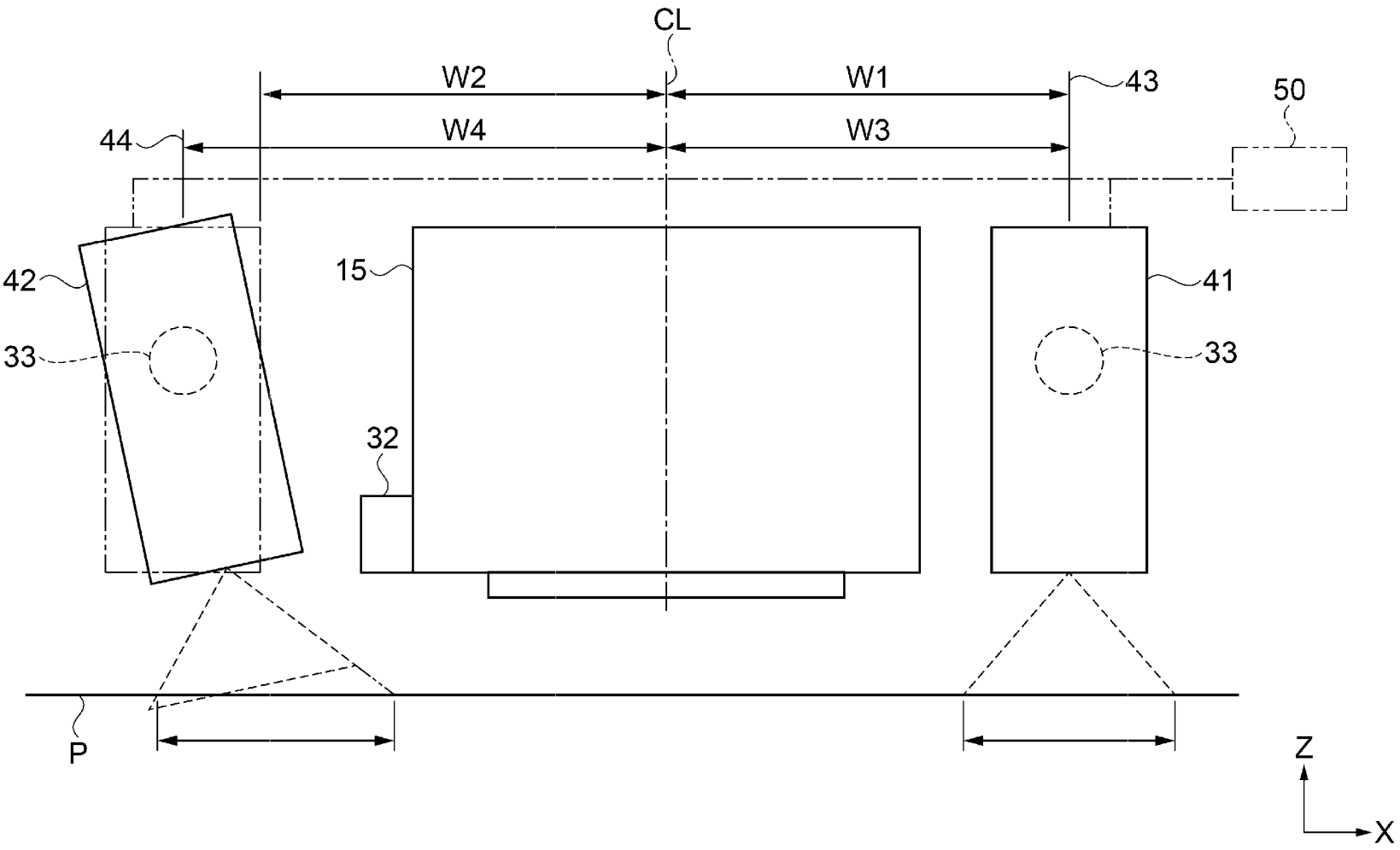
FIG. 4 is a perspective front view of the main scanning unit as viewed from a downstream.

As illustrated in FIG. 3 and FIG. 4, it is desirable that the first irradiation unit 41 and the second irradiation unit 42 are provided symmetrically on the left and right sides with respect to the main scanning direction. The first irradiation unit 41 is provided at the right side, which is one side in the main scanning direction with respect to the reference region 30 at which the nozzle row 23 is provided. The second irradiation unit 42 is provided at the left side, which is another side in the main scanning direction with respect to the reference region 30. Then, a center line CL bisects the reference region 30 provided at the printing head 24 in the main scanning direction. Here, the center line CL bisects a space between the nozzle row 23M and the nozzle row 23C in the main scanning direction.

In the present exemplary embodiment, the first irradiation unit 41 and the second irradiation unit 42 are disposed asymmetrically on the left and right sides with respect to the center line CL due to the convenience of providing the PW sensor 32 between the printing head 24 and the second irradiation unit 42. The center line CL bisects the reference region 30 in the main scanning direction.

Note that the PW sensor 32 illustrated in the present exemplary embodiment may be replaced with or installed in addition to a sensor, etc. such as an image sensor. In this manner, for physical reasons, when the first irradiation unit 41 and the second irradiation unit 42 are disposed asymmetrically on the left and right sides with respect to the center line CL that bisects the reference region 30 in the main scanning direction, the same effect as that of the ultraviolet irradiation units provided symmetrically on the left and right sides can be obtained by a irradiation position of the ultraviolet light described later.

For example, ultraviolet light having a wavelength of from 400 nm to 200 nm can be used as the light generated by the first irradiation unit 41 and the second irradiation unit 42. As other exemplary embodiments, the light generated from the first irradiation unit 41 and the second irradiation unit 42 may be configured by using electromagnetic waves such as visible light, far ultraviolet light, g-line, h-line, i-line, KrF excimer laser light, ArF excimer laser beam, or X-ray. Examples of a light generating means of the first irradiation unit 41 and the second irradiation unit 42 include those that direct light such as, for example, a metal halide lamp, a xenon lamp, a carbon arc lamp, a chemical lamp, a low-pressure mercury lamp, a high-pressure mercury lamp, a H-lamp, a D-lamp, a V-lamp, etc. to the irradiation unit by a light guide, an optical fiber, etc. In particular, ultraviolet light emitting diodes and ultraviolet light emitting semiconductor lasers are preferable for the first irradiation unit 41 and the second irradiation unit 42.

The first irradiation unit 41 and the second irradiation unit 42 according to the present exemplary embodiment use ultraviolet light emitting elements having a wavelength of from 365 nm to 410 nm, in particular. Furthermore, when the ultraviolet light emitting diodes are used for the first irradiation unit 41 and the second irradiation unit 42, the size and weight thereof can be reduced, whereby the degree of freedom of placement of the light emitting elements can be increased. For example, as illustrated in FIG. 3, the first irradiation unit 41 and the second irradiation unit 42 have a configuration in which the ultraviolet light emitting diodes are arranged singularly along the sub scanning direction. Hereinafter, in the present exemplary embodiment, the ultraviolet light emitting diode is simply referred to as an LED.

At least one, and preferably both, of the first irradiation unit 41 and the second irradiation unit 42 preferably have an irradiation peak intensity of 200 mW/cm$^2$ or greater, and more preferably 800 mW/cm$^2$ or greater. When the irradiation peak intensity is within this range, the UV ink can be sufficiently pinned in one main scan in the main scanning direction. The irradiation peak intensity is preferably not greater than 2000 mW/cm$^2$, and more preferably not greater than 1500 mW/cm$^2$. By setting such a range, the freedom of the design can be increased and energy waste can be suppressed. Furthermore, the irradiation energy to irradiate the UV ink in one main scan in at least one, and preferably both, of the first irradiation unit 41 and the second irradiation unit 42, is 40 mJ/cm$^2$ or greater, and more preferably 100 mJ/cm$^2$ or greater. By setting such a range, the UV ink can be sufficiently pinned in a single main scan.

As illustrated in FIG. 4, the first irradiation unit 41 and the second irradiation unit 42 are configured to, when the printing head 24 is scanned in the main scanning direction, irradiate the UV ink discharged from the nozzle holes and landed on the printing medium P with ultraviolet light. By an irradiation position control unit 50 configured to change a irradiation direction with respect to the printing medium P, at least one of the first irradiation unit 41 and the second irradiation unit 42 can be inclined about a rotation axis in the sub scanning direction that intersects with the main scanning direction.

As illustrated in FIG. 4, the irradiation position control unit 50 drives an irradiation position change mechanisms 33 built into each of the left and right pairs of ultraviolet irradiation units. The irradiation position change mechanism 33 is configured, for example, by coupling a link and an eccentric cam (not illustrated) to a rotational movement shaft provided along the sub scanning direction from the center of the ultraviolet irradiation unit. By rotating a motor (not illustrated) by a control signal from the irradiation position control unit 50, the link is rotated and transmitted to the eccentric cam, whereby driving the ultraviolet irradiation unit until it reaches a predetermined inclination.

As illustrated in FIG. 3 and FIG. 4, in a case where the irradiation position is not changed by the irradiation position control unit 50, light emitted from the first irradiation unit 41 and the second irradiation unit 42 is radiated to positions directly below the ultraviolet irradiation unit on the printing medium P. These irradiation positions are referred to as directly-below irradiation positions 43 and 44. Hereinafter, the directly-below irradiation positions 43 and 44 are also referred to as first irradiation positions. On the other hand, when the irradiation position is changed by the irradiation position control unit 50, the irradiation position is referred to as an irradiation position 45 different from the directly-below irradiation positions 43 and 44. the irradiation position different from the directly-below irradiation positions is also referred to as a second irradiation position.

That is, at least one of the first irradiation unit 41 and the second irradiation unit 42 can irradiate a second irradiation position, which is an irradiation position different from the first irradiation positions via the irradiation position control unit 50.

As illustrated in FIG. 4, the second irradiation unit 42 is inclined to the printing head 24 side along the main scanning direction to change the irradiation position to the second irradiation position. As a result, an irradiation time from when the UV ink discharged from the nozzle row 23 lands on the printing medium P until being irradiated by the first irradiation unit 41 and the second irradiation unit 42 with the ultraviolet light can be substantially the same for the forward path and the return path.

Note that the first irradiation unit 41 and the second irradiation unit 42 may, as appropriate, control distances between the irradiation unis and the printing medium P, an increase or decrease in the intensity of the irradiation light, etc.

Furthermore, when performing the printing pass a plurality of times when pinning the UV ink, the pair of ultraviolet irradiation units may be controlled to be turned on simultaneously.

1.4. Printer Control

Figure 5:
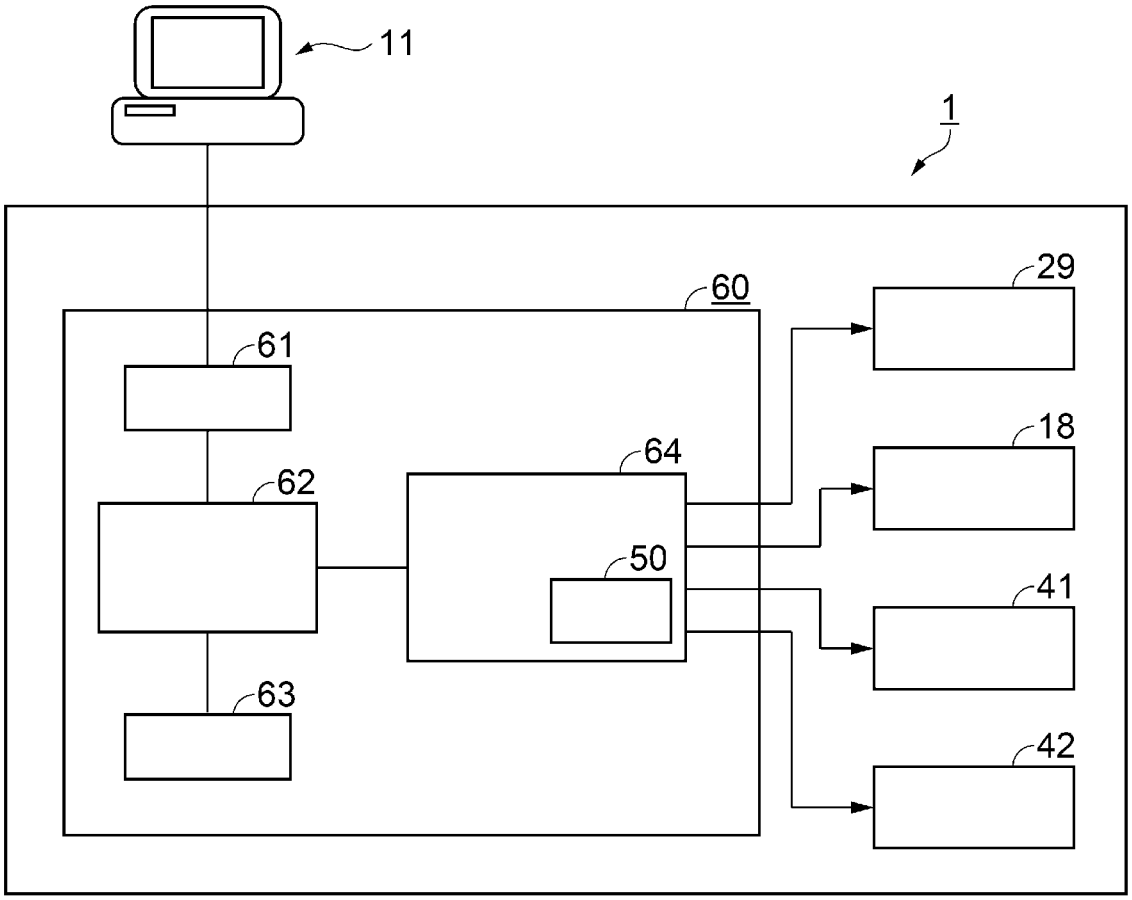
FIG. 5 is a control diagram of the printer.

FIG. 5 illustrates a control schematic diagram of a controller 60 for controlling the entire printer in the printer 1.

The controller 60 of the printer 1 includes a CPU62 for controlling image processing and control signals, an internal memory 63 such as ROM, RAM, etc., an operation unit (not illustrated) provided with a button or a touch panel, a display unit configured by a liquid crystal display, and a control circuit 64 capable of independently controlling a plurality of motors. The controller 60 further includes an I/F unit 61 for connection with an external equipment, such as a personal computer 11. The components of the printer 1 are coupled to each other via a bus.

The I/F unit 61 is an I/F for exchanging data and commands with external equipment. The printer 1 can input image data from the external equipment such as a mobile terminal that is wired or wirelessly connected via the I/F unit 61. An example of the external equipment includes the personal computer 11. The personal computer 11 or the controller 60, or both, is/are used to print image data to be printed specified by the user.

The internal memory 63 stores firmware for causing the CPU62 to control the drive of a transport motor 29 and the carriage motor 18, and to control the first irradiation unit 41 and the second irradiation unit 42. By operation from a control panel provided at a front portion of the printer 1, the display unit of the liquid crystal display may display a predetermined message or a user interface (UI) screen, etc. in the display unit of the liquid crystal display. Note that the firmware stored in the internal memory 63 can be rewritten as appropriate by the user, such as the irradiation conditions of the ultraviolet light. A number of printing passes, which reciprocate the main scanning unit 28 and perform image formation, can be set by the user from the UI screen of the printer driver installed on the personal computer 11.

As illustrated in FIG. 5, the control circuit 64 can independently control the carriage motor 18 that reciprocates the main scanning unit 28 including the carriage 15, the transport motor 29 that transports the printing medium P, and a motor (not illustrated) provided at the irradiation position change mechanism 33 and causing the first irradiation unit 41 and the second irradiation unit 42 to be inclined.

Thus, as illustrated in FIG. 1, the control circuit 64 can control the drive of the transport motor 29 provided at the lower portion of the right end of the rear of the apparatus housing 12, and then transports the printing medium P to a platen 13 that supports the printing medium P from below. The printing medium P, supported by the platen 13, is printed by the printing head 24 and transported further downstream.

Further, the control circuit 64 includes the irradiation position control unit 50, and changes irradiation angles of the first irradiation unit 41 and the second irradiation unit 42 by the irradiation position change mechanism 33. Specifically, a circular shape on the left side indicated by the dotted line on the paper surface in FIG. 3 is an irradiation range in which the irradiation position of the second irradiation unit 42 is changed to the second irradiation position via the irradiation position change mechanism 33 by the control signal from the irradiation position control unit 50 illustrated in FIG. 4.

1.5 Printing Method for Printer

Figure 6:
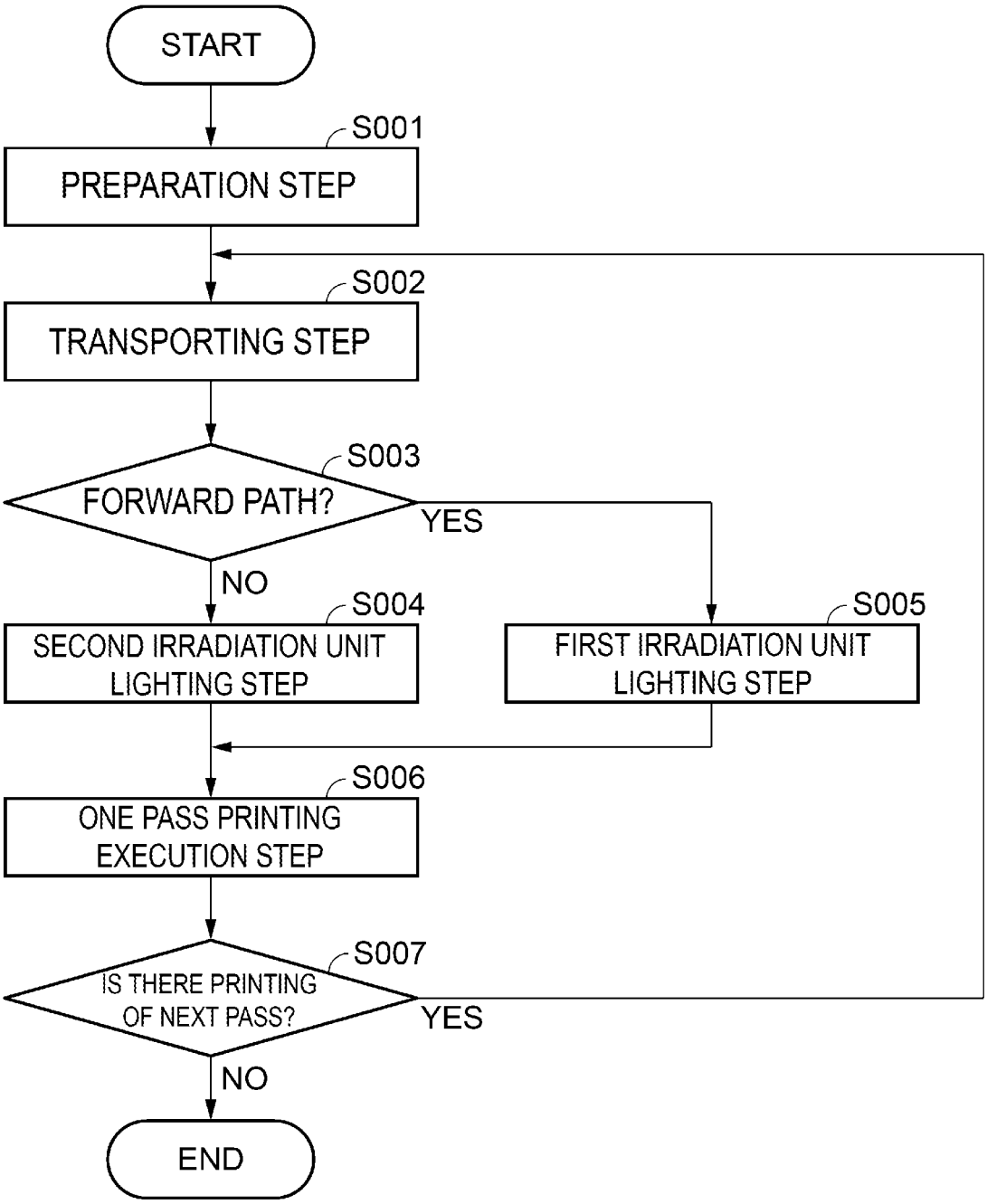
FIG. 6 is a flowchart illustrating a printing method.

FIG. 6 is a diagram illustrating a printing method for the printer 1 in a flowchart.

Step S001 is a preparation step for confirming the irradiation position of the first irradiation unit 41 and the second irradiation unit 42, and determining the irradiation conditions. First, in the preparation step, it is determined whether the first irradiation unit 41 and the second irradiation unit 42 are disposed symmetrically on the left and right sides with respect to the center line CL that bisects the reference region 30 in the main scanning direction. In the case of the printer 1 according to the present exemplary embodiment, the second irradiation unit 42 is determined to be asymmetric on the left and right sides with respect to the center line CL that bisects the reference region 30 in the main scanning direction. With reference to irradiation position change data of the internal memory 63, the irradiation position change mechanism 33 is driven by the control signal from the irradiation position control unit 50 to cause the second irradiation unit 42 to be inclined.

Specifically, the irradiation position of the ultraviolet irradiation unit of the printer 1 is determined by the irradiation conditions according to the following equation. Returning to FIG. 3, at least one of the first irradiation unit 41 provided on one side, in the main scanning direction, of the reference region 30 in which the nozzle row 23 is provided, and the second irradiation unit 42 provided on another side, in the main scanning direction, of the reference region 30, irradiates the directly-below irradiation positions 43, 44, or the irradiation position 45 different from the directly-below irradiation positions 43, 44.

In a case where a distance between the center line CL that bisects the reference region 30 in the main scanning direction and a line passing through a center of an actual irradiation position of the first irradiation unit 41 is a first distance W1, a distance between the center line CL that bisects the reference region 30 in the main scanning direction and a line passing through a center of an actual irradiation position of the second irradiation unit 42 is a second distance W2, a distance between the center line CL that bisects the reference region 30 in the main scanning direction and the directly-below irradiation position 43 of the first irradiation unit 41 is a third distance W3, a distance between the center line CL that bisects the reference region 30 in the main scanning direction and the directly-below irradiation position 44 of the second irradiation unit 42 is a fourth distance W4, then the nozzle row 23, the first irradiation unit 41, and the second irradiation unit 42 are configured so that the third distance W3 and the fourth distance W4 are different from each other, and the printer 1 performs determination so that the following relationship is satisfied: |the first distance W1−the second distance W2|<|the third distance W3−the fourth distance W4|.

In this manner, in step S001, the irradiation position of the second irradiation unit 42 is changed to the second irradiation position as illustrated in FIG. 4.

Step S002 is a transport step for transporting the printing medium P. The controller 60 transports the printing medium P in the sub scanning direction based on the print data.

Step S003 determines whether the next path is a forward path. When it is the forward path (step S003: YES), the process proceeds to step S005. When it is the return path (step S003: NO), the process proceeds to step S004. In step S005, the first irradiation unit 41 on the side opposite to a travel direction of the carriage 15 is caused to light up.

Step S004 is a second irradiation unit lighting step for causing the second irradiation unit 42 to light up. The controller 60 causes the second irradiation unit 42 to light up.

Step S005 is a first irradiation unit lighting step for causing the first irradiation unit 41 to light up. The controller 60 causes the first irradiation unit 41 to light up.

Returning to step S003, it is determined whether the next path is the forward path. Here, it is determined to be the return path (step S003: NO). Then the process proceeds to step S004. In step S004, the second irradiation unit 42 on the side opposite to a travel direction of the carriage 15 is caused to light up.

Step S006 is a one pass printing execution step for scanning the carriage 15 in the main scanning direction to perform printing for one pass. While discharging the UV ink from the printing head 24 mounted at the carriage 15, the controller 60 causes the carriage 15 to move from one of the left and right side towards the other side to form an image.

Note that the controller 60 turns off the first irradiation unit 41 and the second irradiation unit 42 when one pass is completed.

Step S007 is a step for determining whether there is printing of a next pass. The controller 60 generates print data for causing the printer 1 to perform printing based on the image data stored in the internal memory 63. When there is the print data for the next pass (step S007: YES), the process returns to step S002, and then steps S002 to S006 are repeated. When there is no print data for the next pass (step S007: NO), the printing medium P is discharged and the present flow ends.

As illustrated in FIG. 3 and FIG. 4, in a case where image formation is performed while the second irradiation unit 42 is tentatively corresponds to the directly-below irradiation position 44, when the main scanning unit 28 illustrated in FIG. 1 scans in the right direction with the home position from the left of the paper surface, the timing of irradiation to the UV ink that landed on the printing medium P is delayed by a distance of |W4−W3| compared to the case of scanning from the opposite direction. Thus, in a case where the image formation is completed by a plurality of passes, the printing pass causes the main scanning unit 28 to be scanned always from left to right direction, resulting in the printing medium P absorbing more UV ink.

Hereinafter, the reason the difference in the absorption state of the UV ink with respect to the printing medium P causes the gloss irregularity will be described with reference to FIG. 7.

Figure 7:
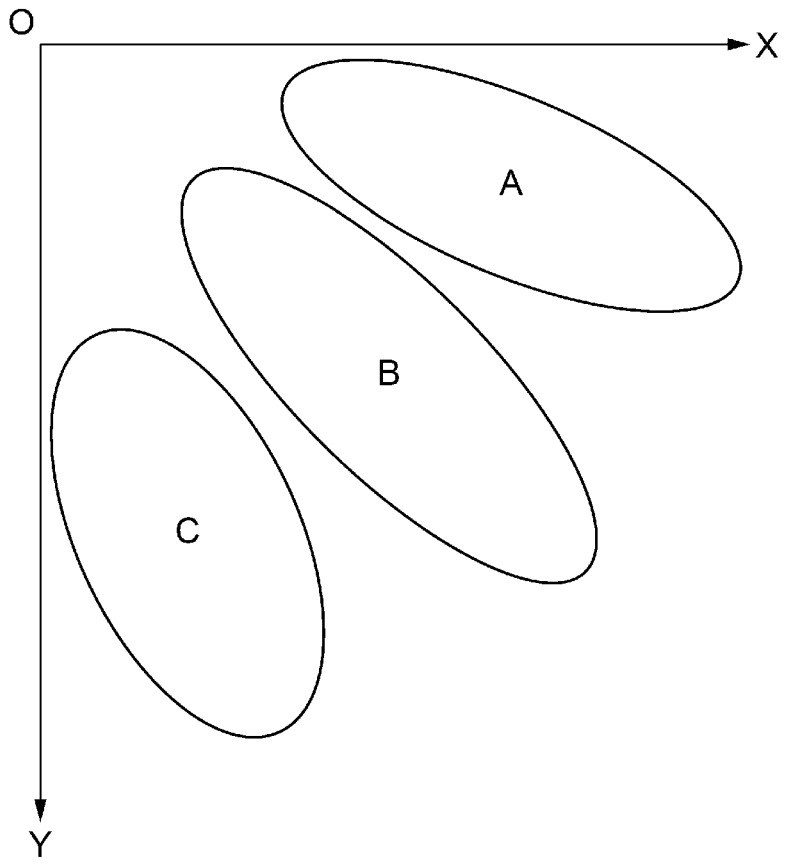
FIG. 7 is a conceptual diagram illustrating a relationship between a number of printing passes and gloss irregularity due to an irradiation time.

In the conceptual graph illustrated in FIG. 7, the horizontal axis represents the number of printing passes. The vertical axis represents the time from when the UV ink lands on the printing medium P until the landed UV ink is irradiated by the ultraviolet irradiation unit on the side opposite to the travel direction in the main scanning direction. Hereinafter, the aforementioned time is simply referred to as the "irradiation time".

Figure 8A:
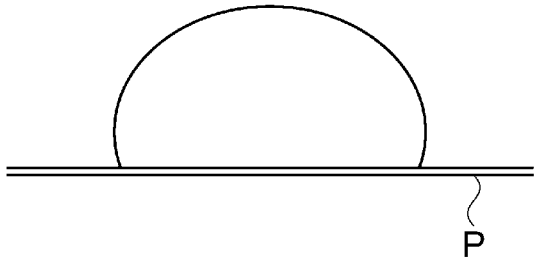
FIG. 8A is a schematic view illustrating a state in which UV ink lands on a printing medium and then absorbed.
Figure 8B:
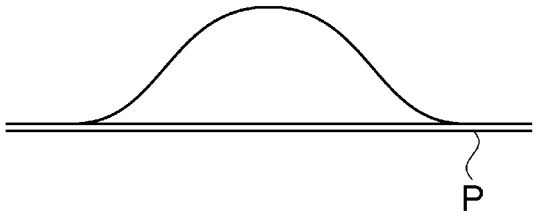
FIG. 8B is a schematic view illustrating a state in which the UV ink lands on the printing medium and then absorbed.
Figure 8C:
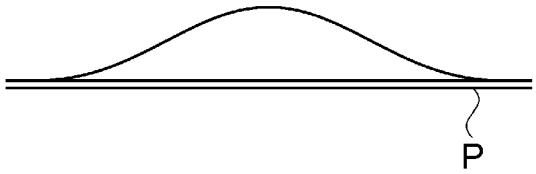
FIG. 8C is a schematic view illustrating a state in which the UV ink lands on the printing medium and then absorbed.

The region A illustrated in FIG. 7 illustrates the state of the UV ink that landed and cured on the printing medium P (FIG. 8A). The region B illustrated in FIG. 7 illustrates the state of the UV ink that landed and cured on the printing medium P (FIG. 8B). The region C illustrated in FIG. 7 illustrates the state of the UV ink that landed and cured on the printing medium P (FIG. 8C).

For example, when the number of printing passes is large and the irradiation time to the UV ink onto the printing medium P is small (i.e. in the region A), the small amount of UV ink is hardly absorbed by the printing medium P and cured before being spread out. Thus, the UV ink landed on the printing medium P is cured while maintaining the dot shape. As a result, the height of the upper surface of the UV ink that landed on the printing medium P is approximately the same as the height of the landed ink droplet, and is stacked for the number of passes. The image, which is stacked leaving the dot shape of these ink droplets, is diffusely reflected because the ink droplets are not integrated, resulting in a so-called matte image.

Conversely, when the number of printing passes is small and the irradiation time to the UV ink onto the printing medium P is large, then the dot shape in the region C is crushed by its own weight, etc. since a large amount of the UV ink is landed on the printing medium P. Furthermore, because the irradiation time is also large, the UV ink is integrated on the printing medium P, and spreads out and then cured. As a result, the height of the ink droplets is not maintained and collapses, thereby becomes wet-spread planar. Thus the ink droplets are specularly reflected, which increases gloss, resulting in a so-called gloss image. These image, in which the states of FIGS. 8A to 8C are mixed, are recognized by the user as having the gloss irregularity. For example, since the printer 1 according to the present exemplary embodiment is substantially aligned in the state of FIG. 8B during bi-directional printing, it is possible to suppress the user from recognizing the gloss irregularity.

Therefore, in order to achieve the region B illustrated in FIG. 7, the printer 1 according to the present exemplary embodiment irradiates the second irradiation unit 42 toward the printing head 24 side in the main scanning direction by the irradiation position control unit 50. As a result, the time from when the UV ink lands on the printing medium P until the UV ink is irradiated with the ultraviolet light is substantially the same for the forward path and the return path.

As described above, if the printer 1 causes at least one of the first irradiation unit 41 and the second irradiation unit 42 to irradiate the irradiation position 45 different from the directly-below irradiation positions 43, 44 to which irradiation is performed directly below, in a case where a distance between the center line CL that bisects the reference region 30 in the main scanning direction and a line passing through a center of an actual irradiation position of the first irradiation unit 41 is a first distance W1, a distance between the center line CL that bisects the reference region 30 in the main scanning direction and a line passing through a center of an actual irradiation position of the second irradiation uni t 42 is a second distance W2, a distance between the center line CL that bisects the reference region 30 in the main scanning direction and the directly-below irradiation position 43 of the first irradiation unit 41 is a third distance W3, a distance between the center line CL that bisects the reference region 30 in the main scanning direction and the directly-below irradiation position 44 of the second irradiation unit 42 is a fourth distance W4, and when the nozzle row, the first irradiation unit 41, and the second irradiation unit 42 of the printer 1 are provided so that the third distance W3 and the fourth distance W4 are different from each other, the first irradiation unit 41 and the second irradiation unit 42 of the printer 1 perform irradiation so that the following relationship is satisfied: |the first distance W1−the second distance W2|<|the third distance W3−the fourth distance W4|.

When satisfying this relationship, the present disclosure can be applied to a printer performing any bi-directional printing, such as a printer for use in operation corresponding to large printing, a home printer for consumer printers, a work printing apparatus for DPE, a textile printing printer, etc.

Figure 9:
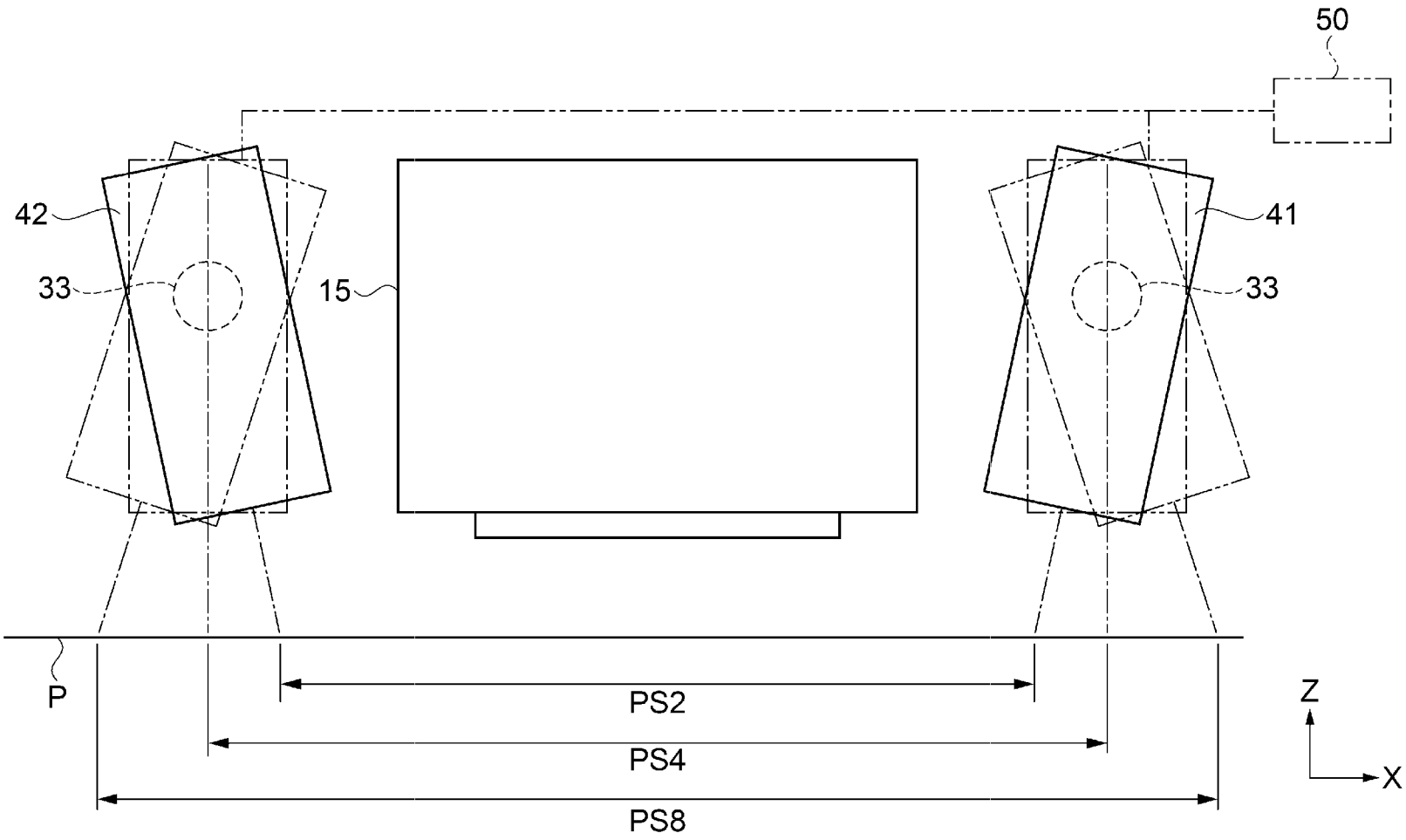
FIG. 9 is a schematic view illustrating a state of the inclination of a pair of ultraviolet irradiation units according to the number of printing passes.

In addition, as illustrated in FIG. 9, for example, in a case where the number of printing passes is PS8 in which the image formation is completed in eight scans, the discharge quantity of the droplets per pass is reduced. As a result, the UV ink is hardly absorbed by the printing medium P, and the time for penetrating the UV ink into the printing medium P needs to be increased. Therefore, at least one of the first irradiation unit 41 and the second irradiation unit 42 irradiates a region on a side opposite to the reference region 30 in the main scanning direction. Here, the first irradiation unit 41 and the second irradiation unit 42 both change the irradiation position via the irradiation position control unit 50 to a region on a side opposite to the reference region 30 in the main scanning direction.

For example, in a case where the number of printing passes is PS4 in which the image formation is completed in four scans, the printer 1 is set to a default value, therefore, the first irradiation unit 41 and the second irradiation unit 42 are controlled to be the directly-below irradiation positions 43, 44.

In addition, for example, in a case where the number of printing passes is PS2 in which the image formation is completed in two scans, the discharge quantity of droplets per pass increases. Therefore, the UV ink is easily absorbed by the printing medium P, and the time for penetrating the printing medium P needs to be shortened. Thus, the first irradiation unit 41 and the second irradiation unit 42 drive the irradiation position change mechanism 33 via the irradiation position control unit 50 to change the irradiation position inclinedly toward the side of the reference region 30.

In other words, the irradiation position control unit 50 performs control for reducing the distance between the irradiation position and the reference region 30 as the number of printing passes decreases when reciprocating the main scanning unit 28 to print the printing medium P.

As described above, according to the printer as the first exemplary embodiment, the following advantages can be achieved.

The printer 1 provided with the pair of ultraviolet irradiation units in the main scanning direction with the printing head 24 interposed therebetween, is provided with an irradiation position so that, in bi-directional printing, at least one ultraviolet irradiation unit performs irradiation to a position other than the directly-below irradiation position. In this manner, by using the pair of ultraviolet irradiation units provided in a position asymmetrically in the main scanning direction with respect to the reference region 30, the time from when the UV ink lands on the printing medium P until the landing of the UV ink is irradiated with the ultraviolet light can be substantially the same for the forward path and the return path. Therefore, in the printer 1, the height of the UV ink that landed on the printing medium P is substantially uniformly aligned in the state illustrated in FIG. 8B, and causes the gloss irregularity to be suppressed, whereby resulting in the improved image quality.

The printer 1 provided with the pair of ultraviolet irradiation units in the main scanning direction with the printing head 24 interposed therebetween is provided with the irradiation position control unit 50 that causes, in bi-directional printing, at least one of the ultraviolet irradiation units to perform irradiation to a position other than the directly-below irradiation position. In such a manner, by using the ultraviolet irradiation unit disposed at a position asymmetrically in the main scanning direction with respect to the reference region 30, the time from when the UV ink lands on the printing medium P until the landed UV ink is irradiated with the ultraviolet light can be substantially the same for the forward path and the return path. Therefore, in the printer 1, the height of the UV ink that landed on the printing medium P is substantially uniformly aligned in the state illustrated in FIG. 8B, and causes the gloss irregularity to be suppressed, whereby resulting in the improved image quality.

The printer 1 provided with the pair of ultraviolet irradiation units in the main scanning direction with the printing head 24 interposed therebetween, is disposed inclinedly with respect to the sub scanning direction that intersects with the main scanning direction so as to cause, in bi-directional printing, at least one of the ultraviolet irradiation units to perform irradiation to a position other than the directly-below irradiation position. In such a manner, by using the ultraviolet irradiation unit disposed at a position asymmetrically in the main scanning direction with respect to the reference region 30, the time from when the UV ink lands on the printing medium P until the landed UV ink is irradiated with the ultraviolet light can be substantially the same for the forward path and the return path. Therefore, in the printer 1, the height of the UV ink that landed on the printing medium P is substantially uniformly aligned in the state illustrated in FIG. 8B, and causes the gloss irregularity to be suppressed, whereby resulting in the improved image quality.

The printer 1 provided with the pair of ultraviolet irradiation units in the main scanning direction with the printing head 24 interposed therebetween can be disposed with an optical axis inclined outside the printing head 24 so as to cause, in bi-directional printing, at least one of the ultraviolet irradiation units to perform irradiation to a position other than the directly-below irradiation position. In such a manner, by using the ultraviolet irradiation unit disposed at a position asymmetrically in the main scanning direction with respect to the reference region 30, the time from when the UV ink lands on the printing medium P until the landed UV ink is irradiated with the ultraviolet light is substantially the same for the forward path and the return path. Therefore, the height of the UV ink that landed on the printing medium P is substantially uniformly aligned in the state illustrated in FIG. 8B, and causes the gloss irregularity to be suppressed, whereby resulting in the improved image quality.

The printer 1 provided with the pair of ultraviolet irradiation units in the main scanning direction with the printing head 24 interposed therebetween reduces the discharge quantity of droplets per pass in proportion to the larger number of printing passes. Therefore, in a case where the number of printing passes is small, the irradiation position control unit 50 is controlled so that the ultraviolet irradiation unit is inclined toward the printing head 24 side with the sub scanning direction as an axis. In a case where the number of printing passes is small, the discharge quantity of droplets per pass increases, so the penetration into the printing medium P is fast, and it is necessary to perform pinning by irradiating the printing medium P with the ultraviolet light as soon as possible.

In addition, in a case where the number of printing passes is large, the irradiation position control unit 50 is controlled so that the ultraviolet irradiation unit is inclined to the outside of the printing head 24 with the sub scanning direction as an axis. This is because, in a case where the number of printing passes is large, the discharge quantity of droplets per pass is small, and the penetration into the printing medium P is slow, so the state of FIG. 8B is approached by irradiating the printing medium P with the ultraviolet light as slow as possible. By controlling the irradiation position control unit 50 with the number of printing passes in this manner, the time from when the UV ink lands on the printing medium P until the landed UV ink is irradiated with the ultraviolet light can be substantially the same for the forward path and the return path by using the ultraviolet irradiation unit. Therefore, the height of the UV ink that landed on the printing medium P is substantially uniformly aligned in the state illustrated in FIG. 8B, and causes the gloss irregularity to be suppressed, whereby resulting in the improved image quality.

For the printing method for the printer 1 provided with the pair of ultraviolet irradiation units in the main scanning direction with the printing head 24 interposed therebetween, the printing method includes, prior to the transport step, the preparation step for performing bi-directional printing in which the optical axis is inclined with respect to the sub scanning direction that intersects with the main scanning direction so as to cause at least one of the ultraviolet irradiation units to perform irradiation to a position other than the directly-below irradiation position. In such a manner, by using the pair of the ultraviolet irradiation units disposed at positions asymmetrically in the main scanning direction with respect to the reference region 30, the first irradiation unit lighting step and the second irradiation unit lighting step are provided in which the time from when the UV ink lands on the printing medium P until the landed UV ink is irradiated with the ultraviolet light can be substantially the same for the forward path and the return path. In the printer 1 provided with the preparation step and the irradiation unit lighting step, etc. for the ultraviolet irradiation unit, the height of the UV ink that landed on the printing medium P is substantially uniformly aligned in the state illustrated in FIG. 8B, and causes the gloss irregularity to be suppressed, whereby resulting in the improved image quality.

2. Second Exemplary Embodiment

Unless otherwise stated, the same configuration as that of the first exemplary embodiment is used. A printer 2 according to the second exemplary embodiment differs in configuration from the first exemplary embodiment to the printing head and the first and second irradiation units.

2.1. Printing Head

Figure 10:
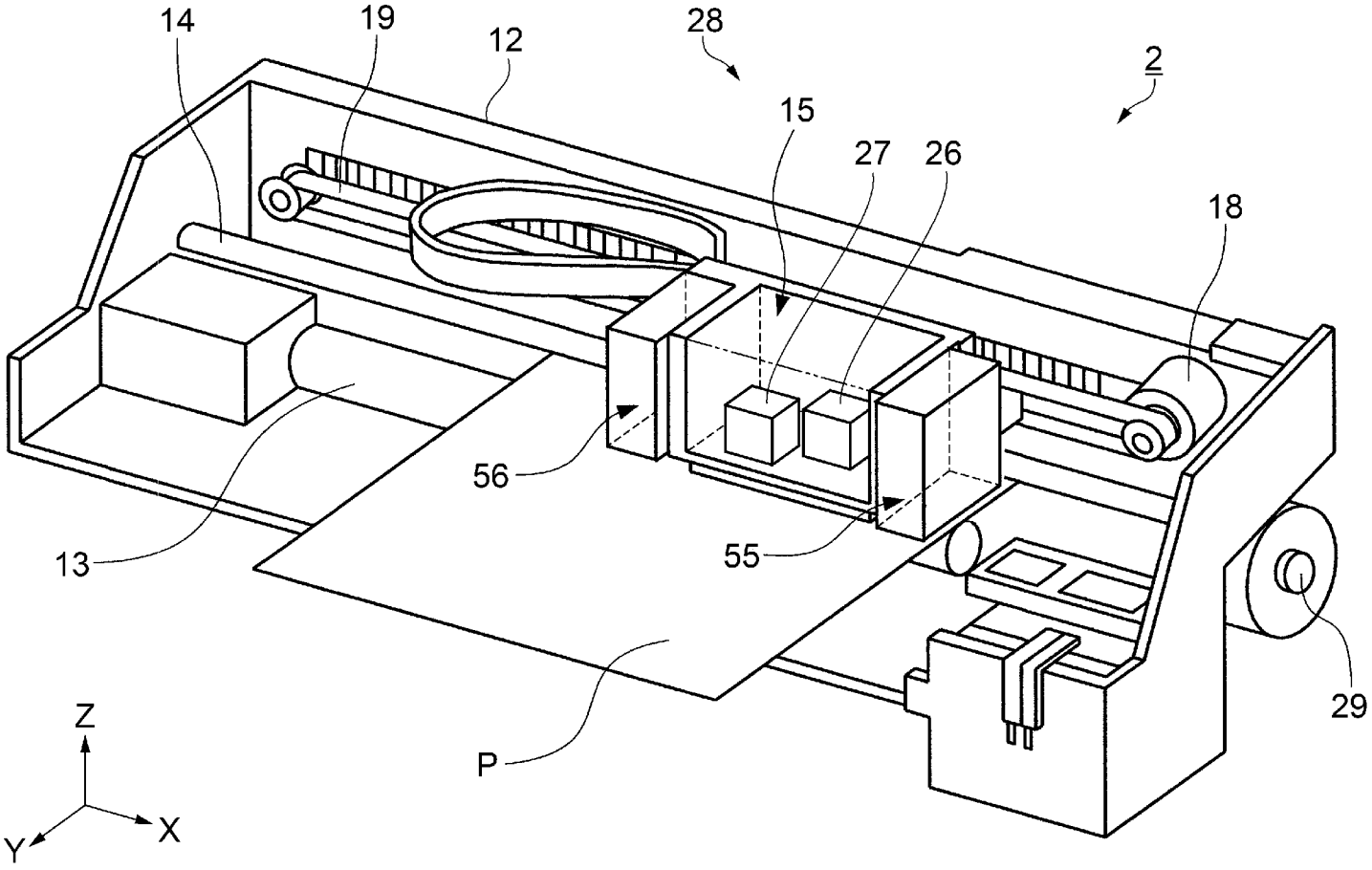
FIG. 10 is a perspective view illustrating the entire printer according to a second exemplary embodiment.
Figure 11:
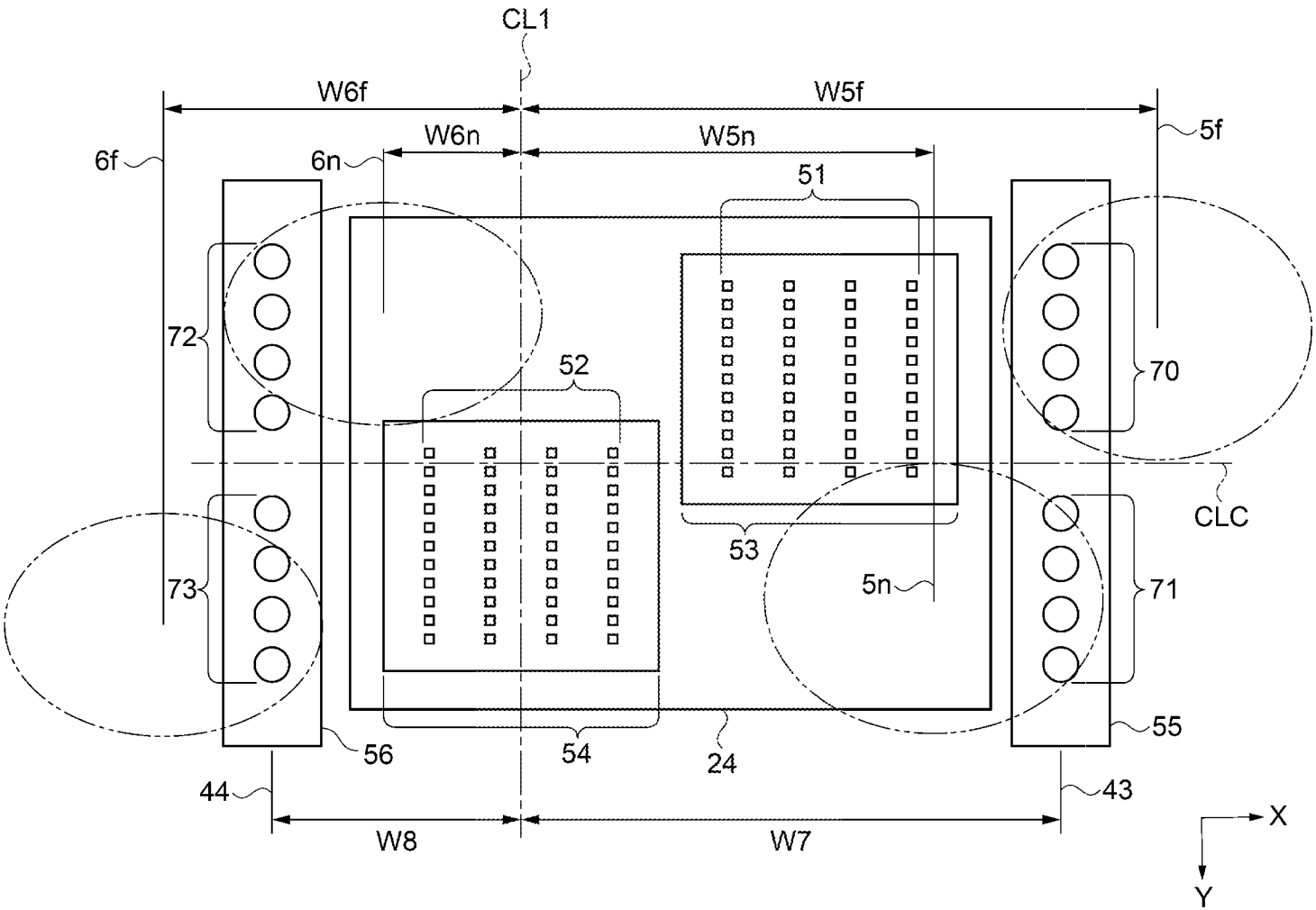
FIG. 11 is a perspective plan view of the main scanning unit as viewed from above.

As illustrated in FIG. 10, in the printer 2, a first printing head 26 and a second printing head 27 are mounted at the carriage 15. As illustrated in FIG. 11, a first nozzle row 51 as a nozzle row provided at the first printing head 26 and a second nozzle row 52 as a nozzle row provided at the second printing head 27 have a so-called stagger structure in which positions in the main scanning direction and the sub scanning direction are provided at different positions with respect to the position of the first nozzle row 51. Hereinafter, with respect to a reference region 53 in which the first nozzle row 51 is provided, a reference region in which the second nozzle row 52 is provided is referred to as a first reference region 54. The first nozzle row 51 and the second nozzle row 52 of the printing heads 26 and 27 installed in the stagger structure are both in a asymmetric positional relationship on the left and right sides with respect to the first irradiation unit 55 and the second irradiation unit 56.

Note that, as illustrated in FIG. 10, in the second exemplary embodiment, a configuration in which the first nozzle row 51 and the second nozzle row 52 are arranged parallel to the sub scanning direction will be described. Also, although not illustrated, a configuration may be employed in which the first nozzle row 51 and the second nozzle row 52 are arranged inclinedly with respect to the sub scanning direction. In addition, a configuration may be employed in which either the first nozzle row 51 or the second nozzle row 52 are inclined with respect to the sub scanning direction.

2.2. Ultraviolet Irradiation Unit

As illustrated in FIG. 11, the irradiation directions of the first irradiation unit 55 and the second irradiation unit 56 are changed on the upstream and the downstream along the center line CLC inside each of them. The first irradiation unit 55 is divided into two on the upstream and the downstream. The first irradiation unit 55 is provided with an LED group 70 on the upstream and an LED group 71 on the downstream. The LED group 70 and the LED group 71 are arranged together in the Y direction. The second irradiation unit 56 is divided into two on the upstream and the downstream. The second irradiation unit 56 is provided with an LED group 72 on the upstream and an LED group 73 on the downstream. The LED group 72 and the LED group 73 are arranged together in the Y direction.

Figure 12:
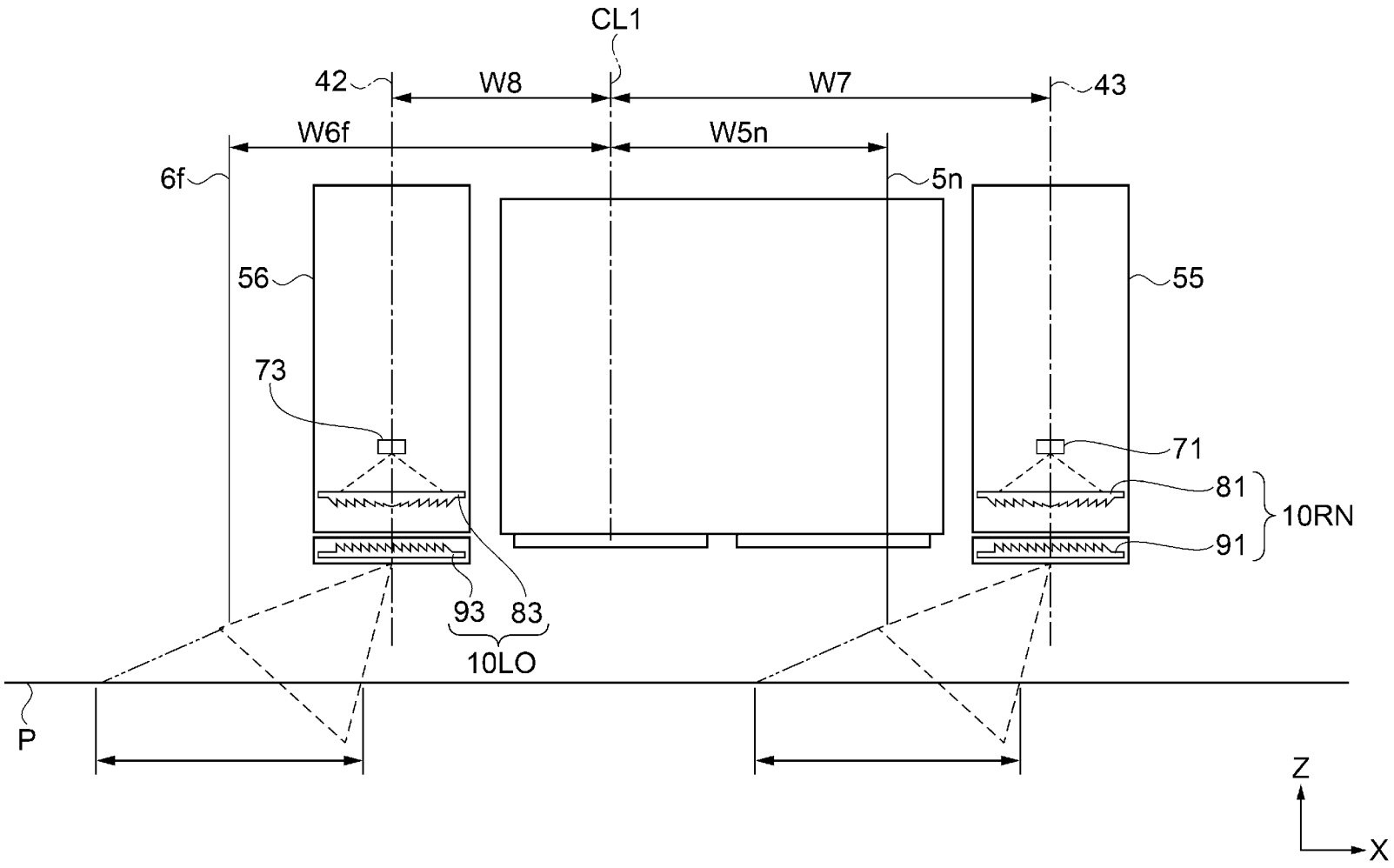
FIG. 12 is a perspective front view of the main scanning unit as viewed from a downstream.

FIG. 12 is a schematic view of FIG. 10 as viewed from the downstream along the Y direction.

As illustrated in FIG. 12, the LED group 71 provided at the downstream of the first irradiation unit 55 all performs irradiation with ultraviolet light along the lower side in the Z direction. An irradiation position control unit 10RN is provided below the LED group 71. The irradiation position control unit 10RN changes the irradiation position to a second irradiation position, which is a line 5*n* that passes through a center that bisects the ultraviolet light emitted from the LED group 71 in the main scanning direction. For example, the irradiation position control unit 10RN is provided with a Fresnel lens group 81 facing the bottom of the LED group 71 and a half prism group 91 facing the bottom of the Fresnel lens group 81. The light of the LED group 71 changes the irradiation position to an irradiation position, which is the line 5*n* that passes through a center that bisects the light of the half prism group 91 in the main scanning direction on the printing head 27 side via the Fresnel lens group 81.

In addition, the LED group 70 provided at the upstream of the first irradiation unit (not illustrated in FIG. 12) all performs irradiation with ultraviolet light along the lower side in the Z direction. An irradiation position control unit 10RO (not illustrated) is provided below the LED group 70. The irradiation position control unit 10RO changes the irradiation position to an irradiation position serving as a center line 5*f* that bisects the ultraviolet light emitted from the LED group 70 in the main scanning direction. For example, the irradiation position control unit 10RO is provided with a Fresnel lens group 80 facing the bottom of the LED group 70 and a half prism group 90 facing the bottom of the Fresnel lens group 80. The light of the LED group 70 changes the optical axis to a line 5*f* that passes through the center of the irradiation position opposite the printing head 24 of the light of the half prism group 90 via the Fresnel lens group 80. However, the upstream irradiation position control unit 10RO is provided with a downstream half prism group 90 rotated 180° as an upstream half prism group 90. Therefore, for the irradiation position control unit 10RN on the downstream and the irradiation position control unit 10RO on the upstream, the optical axes thereof are changed to the line 5*n* and the line 5*f*, respectively, which are symmetrical positions on the left and right sides with respect to the directly-below irradiation position 43 of the first irradiation section 55.

As illustrated in FIG. 12, the LED group 73 provided at the downstream of the second irradiation unit 56 all performs irradiation with ultraviolet light along the lower part of the Z-axis. An irradiation position control unit 10LO is provided below the LED group 73. The irradiation position control unit 10LO changes the irradiation position to a second irradiation position, which is a line 6*f* that passes through a center that bisects the ultraviolet light emitted from the LED group 73 in the main scanning direction. For example, the irradiation position control unit 10LO is provided with a Fresnel lens group 83 facing the bottom of the LED group 73 and a half prism group 93 facing the bottom of the Fresnel lens group 83. The light of the LED group 73 changes irradiation position to an irradiation position, which is the line 6*f* that passes through a center that bisects the light of the half prism group 93 in the main scanning direction via the Fresnel lens group 83. The line 6*f* is a second irradiation position outside of the printing head 26.

In addition, the LED group 72 provided at the upstream of the second irradiation unit 56 (not illustrated in FIG. 12) all performs irradiation with ultraviolet light along the lower side in the Z direction. An irradiation position control unit 10LN (not illustrated) is provided below the LED group 72. The irradiation position control unit 10LN can change the ultraviolet light emitted from the LED group 72 to a line 6*n* that passes through a center of an irradiation position different from the directly-below irradiation position 44. For example, the irradiation position control unit 10LN is provided with a Fresnel lens group 82 facing below the LED group 72 and a half prism group 92 facing downward from the Fresnel lens group 82. The light of the LED group 72 changes the optical axis to a line 6*n* that passes through the center of the irradiation position on the printing head 24 side of the light of the half prism group 92 via the Fresnel lens group 82. However, the upstream irradiation position control unit 10LN is provided with a downstream half prism group 92 rotated 180° as an upstream half prism group 92. Therefore, for the irradiation position control unit 10LO on the downstream and the irradiation position control unit 10LN on the upstream, the optical axes thereof are changed to the line 6*n* and the line 6*f*, respectively, which are symmetrical on the left and right sides with respect to the directly-below irradiation position 44 of the second irradiation unit 56.

Note that the Fresnel lens group and the half prism group are used as the irradiation position control unit of the second exemplary embodiment, but only half prism may be used as one example of a planar lens. In addition, the optical axis may be changed by configuring a half prism that changes the optical axis at an angle different from that of the half prism, a planar lens having other shapes, or a lens group in which a collection lens is combined.

2.3 Printing Method for Printer

The printer 2 does not include step S001 of the printer 1 illustrated in FIG. 6. This is because the irradiation position of the first irradiation unit 55 and the second irradiation unit 56 is set by a value determined by an equation described below.

Note that step S001 of the printer 1 may be incorporated to allow the irradiation position to be set automatically by the irradiation position change mechanism upstream and downstream of each of the first irradiation unit 55 and the second irradiation unit 56.

In order to suppress the gloss irregularity, the printer 2 makes the time from when the UV ink lands on the printing medium P until being irradiated by the ultraviolet irradiation unit behind the carriage 15 in the travel direction to be substantially the same for the forward path and the return path. As illustrated in FIG. 11, in the printer 2 where the second nozzle row 52 is provided at a position different from a position in the main scanning direction and a position in the a scanning direction with respect to the position of the first nozzle row 51, in a case where distances between a line CL1 that passes through the center that bisects the first reference region 54 in the main scanning direction where the second nozzle row 52 is provided and the lines 5*n*, 5*f* that pass through the center of the irradiation position of the actual first irradiation unit 55 are fifth distances W5*n*, W5*f*, distances between the line CL1 that passes through the center that bisects the first reference region 54 in the main scanning direction and the lines 6*n*, 6*f* that pass through the center of the irradiation position of the actual second irradiation unit 56 are sixth distances W6*n*, W6*f*, a distance between the line CL1 that passes through the center that bisects the first reference region 54 in the main scanning direction and the directly-below irradiation position 43 of the first irradiation unit 55 is a seventh distance W7, and a distance between the line CL1 that passes through the center that bisects the first reference region 54 in the main scanning direction and the directly-below irradiation position 44 of the second irradiation unit 56 is an eighth distance W8, and when the nozzle row, the first irradiation unit 55, and the second irradiation unit 56 of the printer 2 are provided so that the seventh distance W7 and the eighth distance W8 are different from each other, the first irradiation unit 55 and the second irradiation unit 56 of the printer 2 perform irradiation so that the following relationship is satisfied: |the fifth distance W5*f*−the sixth distance W6*f*|<|the seventh distance W7−the eighth distance W8| and |the fifth distance W5*n*−the sixth distance W6*n*|<|the seventh distance W7−the eighth distance W8|.

For example, as illustrated in FIG. 12, the irradiation position control units 10RN, 10LO and the upstream irradiation position control unit 10RO, 10LO (not illustrated) tilt the irradiation positions 5*n*, 6*f* and the irradiation positions 5*f*, 6*n* (not illustrated) different from the directly-below irradiation positions 43, 44 of the first irradiation unit 55 and the second irradiation unit 56, respectively, at an optical axis of approximately ±20° to the main scanning direction from below parallel to the Z direction.

For the printer 2 that has a relationship that satisfies the above equation, the time from when the UV ink discharged from the printing heads 26, 27 having the stagger structure lands on the printing medium P until the landed UV ink is irradiated by the first irradiation unit 55 and the second irradiation unit 56 with the ultraviolet light can be substantially the same for the forward path and the return path.

Further, when the above equation is satisfied, the first irradiation unit 55 and the second irradiation unit 56 can optionally control a distance to the printing medium P and the increase/decrease in the intensity of the irradiation light.

As described above, according to the printer 2 as the second exemplary embodiment, the following advantages can be achieved.

The printer 2 provided with the pair of ultraviolet irradiation units in the main scanning direction with the printing heads 26, 27 interposed therebetween is configured with the stagger structure in which the position of the second nozzle row 52 is disposed differently from the position of the first nozzle row 51 in the main scanning direction and the sub scanning direction. The printer 2 is provided with the irradiation position control units 10RO, 10RN, 10LN, and 10LO that cause, in bi-directional printing, the ultraviolet irradiation unit to perform irradiation to a position other than the directly-below irradiation position. For example, the first irradiation unit 55 and the second irradiation unit 56 can change the irradiation directions of the ultraviolet light on the upstream and the downstream along the center line CLC inside each of them. In such a manner, by using the first irradiation unit 55 and the second irradiation unit 56, the time from when the UV ink discharged from the first nozzle row 51 and the second nozzle row 52 having the staggered structure lands on the printing medium P until the landed UV ink is irradiated with the ultraviolet light can be substantially the same for the forward path and the return path. Therefore, in the printer 2, the height of the UV ink that landed on the printing medium P is substantially uniformly aligned in the state illustrated in FIG. 8B, and causes the gloss irregularity to be suppressed, whereby resulting in the improved image quality.

What is claimed is:

1. A printing apparatus comprising:

a nozzle row configured to discharge ink onto a printing medium;

a main scanning unit configured to change a relative position between the printing medium and the nozzle row in a main scanning direction;

a first irradiation unit provided on one side, in the main scanning direction, of a reference region in which the nozzle row is provided; and a second irradiation unit provided on another side, in the main scanning direction, of the reference region, wherein at least one of the first irradiation unit and the second irradiation unit is configured to perform irradiation at an irradiation position different from a directly-below irradiation position, the directly-below irradiation position being a irradiation position when irradiation is performed directly below, when a distance between a center of the reference region and a center of the irradiation position of the first irradiation unit is a first distance, a distance between the center of the reference region and a center of the irradiation position of the second irradiation unit is a second distance, a distance between the center of the reference region and a center of the directly-below irradiation position of the first irradiation unit is a third distance, and a distance between the center of the reference region and a center of the directly-below irradiation position of the second irradiation unit is a fourth distance, the nozzle row, the first irradiation unit, and the second irradiation unit are provided so that the third distance and the fourth distance are different from each other, and the first irradiation unit and the second irradiation unit are configured to perform irradiation so that the following condition is satisfied: |the first distance−the second distance|<|the third distance−the fourth distance|.

2. The printing apparatus according to claim 1, comprising an irradiation position control unit configured to change an irradiation direction of at least one of the first irradiation unit and the second irradiation unit, wherein at least one of the first irradiation unit and the second irradiation unit is configured to, with use of the irradiation position control unit, irradiate the irradiation position different from the directly-below irradiation position.

3. The printing apparatus according to claim 2, wherein the irradiation position control unit is configured to reduce a distance between the irradiation position and the reference region as a number of printing passes decreases, the printing passes being reciprocation of the main scanning unit for performing printing on the printing medium.

4. The printing apparatus according to claim 1, wherein at least one of the first irradiation unit and the second irradiation unit is provided inclinedly with respect to a sub scanning direction as an axis, the sub scanning direction intersecting with the main scanning direction.

5. The printing apparatus according to claim 1, wherein at least one of the first irradiation unit and the second irradiation unit is configured to irradiate a region on a side opposite from the reference region in the main scanning direction.

6. The printing apparatus according to claim 1, wherein the nozzle row is a first nozzle row, a second nozzle row is further provided, the second nozzle row being different from the first nozzle row, the second nozzle row is provided at a position different from a position of the first nozzle row in the main scanning direction and in a sub scanning direction that intersects with the main scanning direction, when a distance between a center of a first reference region in which the second nozzle row is provided and a center of a irradiation position of the first irradiation unit is a fifth distance, a distance between a center of the first reference region and a center of a irradiation position of the second irradiation unit is a sixth distance, a distance between the center of the first reference region and a center of the directly-below irradiation position of the first irradiation unit is a seventh distance, and a distance between the center of the first reference region and a center of the directly-below irradiation position of the second irradiation unit is an eighth distance, the second nozzle row, the first irradiation unit, and the second irradiation unit are provided so that the seventh distance and the eighth distance are different from each other, and the first irradiation unit and the second irradiation unit are configured to perform irradiation so that the following condition is satisfied: |the fifth distance−the sixth distance|<|the seventh distance−the eighth distance|.

7. A printing method for a printing apparatus including:

a nozzle row configured to discharge ink onto a printing medium;

a main scanning unit configured to change a relative position between the printing medium and the nozzle row in a main scanning direction;

a first irradiation unit provided on one side, in the main scanning direction, of a reference region in which the nozzle row is provided; and a second irradiation unit provided on another side, in the main scanning direction, of the reference region, wherein at least one of the first irradiation unit and the second irradiation unit is configured to perform irradiation at an irradiation position different from a directly-below irradiation position, the directly-below irradiation position being a irradiation position when irradiation is performed directly below, when a distance between a center of the reference region and a center of an irradiation position of the first irradiation unit is a first distance, a distance between the center of the reference region and a center of an irradiation position of the second irradiation unit is a second distance, a distance between the center of the reference region and a center of the directly-below irradiation position of the first irradiation unit is a third distance, and a distance between the center of the reference region and a center of the directly-below irradiation position of the second irradiation unit is a fourth distance, the nozzle row, the first irradiation unit, and the second irradiation unit are provided so that the third distance and the fourth distance are different from each other, and the printing method comprises a first irradiation unit lighting step for lighting up the first irradiation unit and a second irradiation unit lighting step for lighting up the second irradiation unit so that the following condition is satisfied: |the first distance−the second distance|<|the third distance−the fourth distance|.

* * * * *